United States Patent [19]

Byrne et al.

[11] 4,241,247

[45] Dec. 23, 1980

[54] CONTROLLER FOR ROTARY COLLATOR

[75] Inventors: Leroy H. Byrne, Waterbury; Arnold Fassman, Westport, both of Conn.

[73] Assignee: Pitney Bowes Inc., Stamford, Conn.

[21] Appl. No.: 908,747

[22] Filed: May 23, 1978

[51] Int. Cl.[3] ..... H01H 3/16

[52] U.S. Cl. ..... 200/61.41

[58] Field of Search ..... 200/38 CA, 61.41, 61.42, 200/332, 153 L, 153 T

[56] References Cited

U.S. PATENT DOCUMENTS

| | | | |
|---|---|---|---|
| 2,571,818 | 10/1951 | Blodgett | 200/332 X |
| 2,802,914 | 8/1957 | Karkow, Jr. | 200/61.41 |
| 3,101,418 | 8/1963 | Gould | 200/38 CA X |
| 3,229,059 | 1/1966 | Beatty | 200/61.41 |
| 3,426,165 | 2/1969 | Beaman | 200/61.41 |
| 3,538,284 | 11/1970 | Alexander et al. | 200/153 L |
| 3,718,785 | 2/1973 | Kudritzki | 200/332 X |

FOREIGN PATENT DOCUMENTS

| | | | |
|---|---|---|---|
| 149708 | 10/1961 | U.S.S.R. | 200/61.42 |

*Primary Examiner*—James R. Scott

*Attorney, Agent, or Firm*—Mark Levy; William D. Soltow, Jr.; Albert W. Scribner

[57] ABSTRACT

A rotary collator with a plurality of radially extending partitions in which sheets to be collated are held by a sheet clamp mounted in each bin. The sheet clamp for each bin is released during the sheet ejecting portion of the collating cycle according to a program implemented by a programming disc into which selector pins corresponding to specified bins are inserted. The programming disc moves relative to an electromechanical mechanism which enables an electrical switch to complete a circuit to release the clamps. The spacing of the selector pins is such that consecutive empty bins require the electrical switch to be maintained in a disabled position, while consecutive loaded bins result in maintaining the electrical switch in an enabled position, thereby eliminating bouncing of the switch.

3 Claims, 8 Drawing Figures

FIG. 4
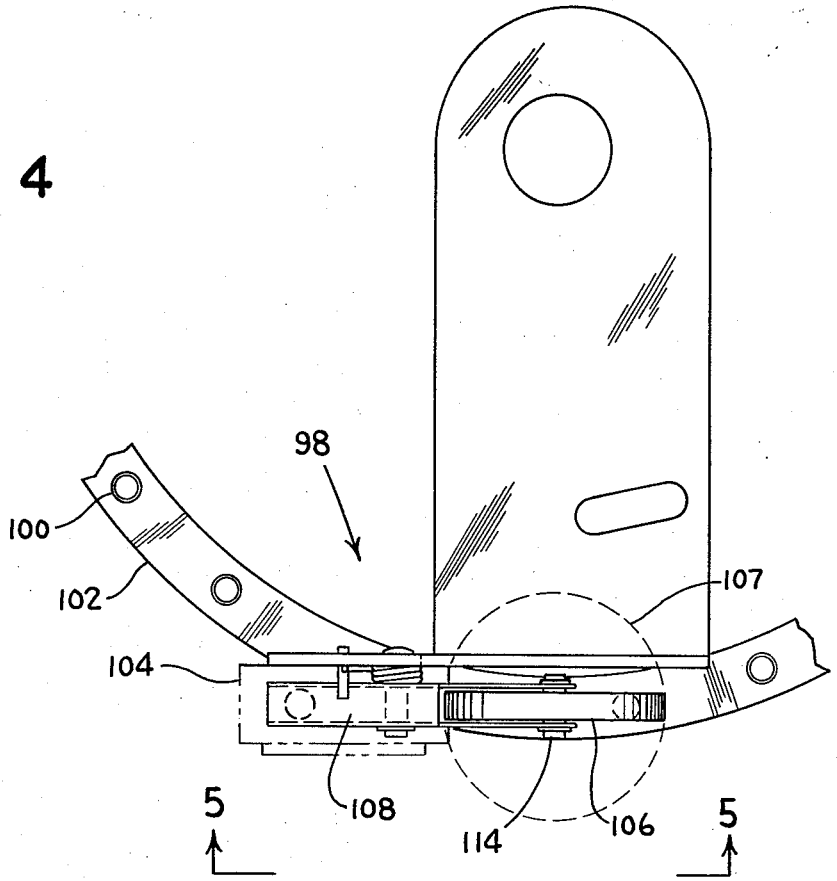
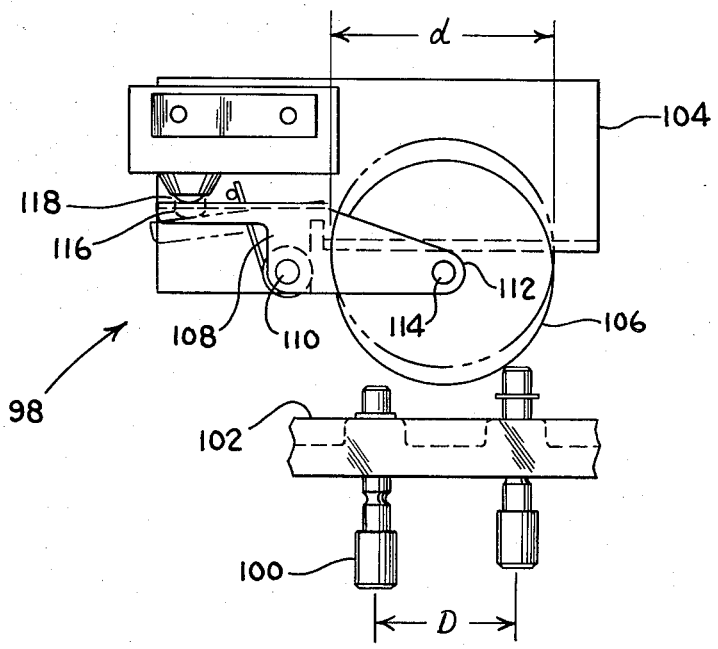
FIG. 5

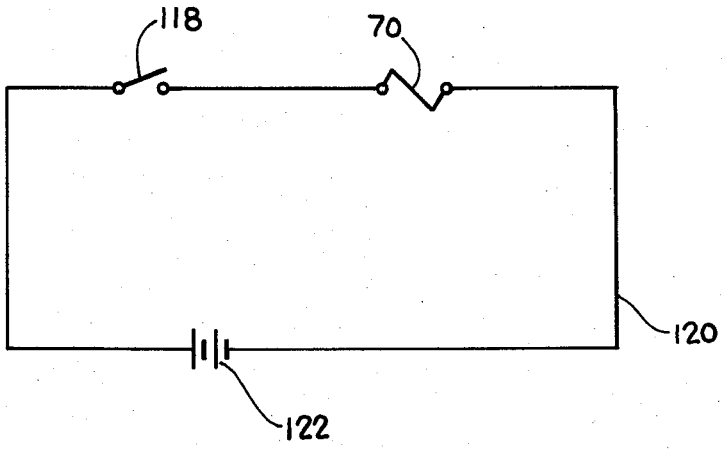
FIG. 6
FIG. 7
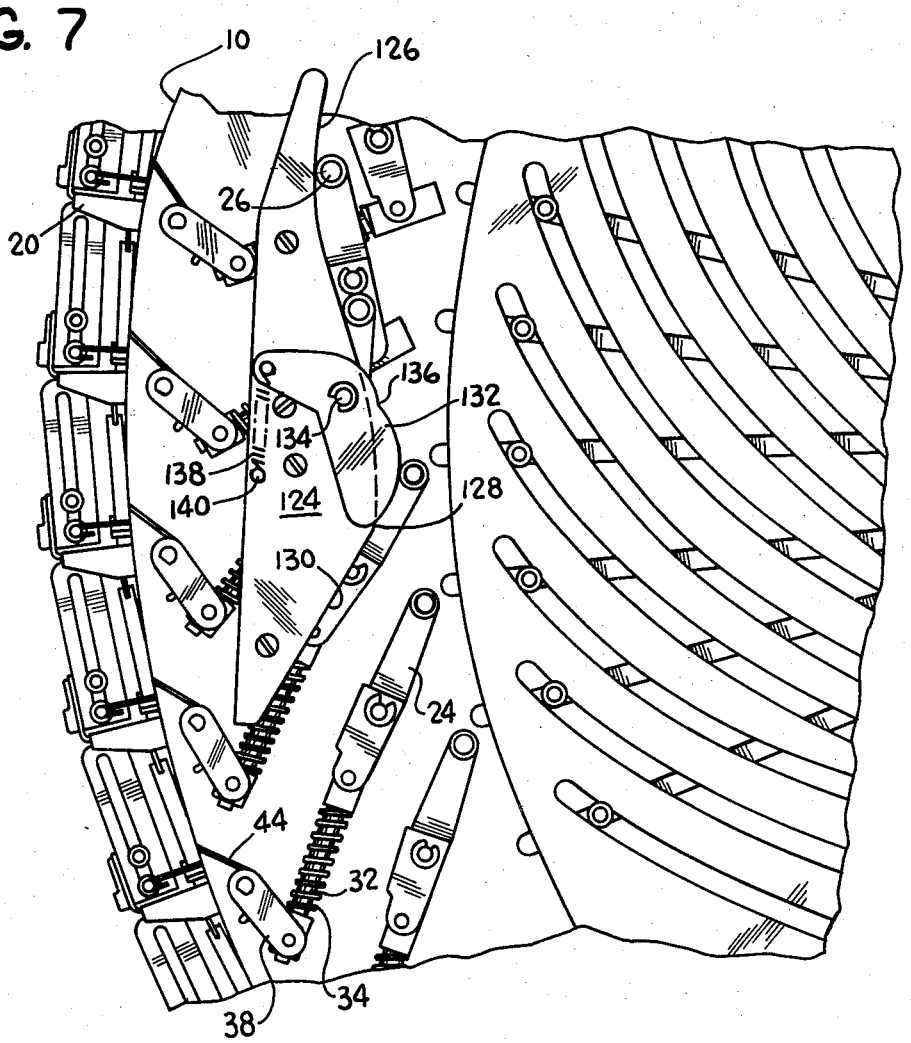

CONTROLLER FOR ROTARY COLLATOR

BACKGROUND OF THE INVENTION

1. Field of the Invention

The present invention relates, in general, to a sheet handling device and, more particularly, to an electrically powered rotary collator which collates sheets.

Rotary collators use a rotating drum with radially extending partitions which divide the drum into radially extending bins. Each successive bin may be loaded with a plurality of sheets of successive pages of a booklet to be collated. Some of the bins may be empty. As the drum rotates, the pile of sheets in each loaded bin is held against its bin by a sheet clamp except at a sheet ejecting position or a region thereof when the stack of sheets must be released or unclamped so that the top sheet can be withdrawn from the bin. A sheet from each of the loaded bins is withdrawn and the sheets are assembled together in sequence so that they may be stapled or otherwise bound together.

After each bin passes the sheet ejecting position, the sheet clamp is operated to clamping position by an activating device that uses a toggle structure. In known machines, the sheet clamp held against each bin is released when the bin reaches its ejecting position and is clamped again soon after the bin moves beyond its ejecting position. In these previous systems, the clamping/unclamping procedure takes place on each bin irrespective of whether sheets are loaded in the particular bin in question.

The clamping springs used are strong enough to hold thick stacks of sheets against the partition side. Consequently, the cumulative effect of the noise generated by released sheet clamps slamming shut against empty bins is significant in these previous systems. In addition, individual elements of the mechanism are subject to wear, despite the fact that their functions are not always required.

2. Description of the Prior Art

U.S. Pat. No. 2,936,168 teaches the use of a rotating drum with radially extending partitions. No provision is made therein for programmably disabling sheet clamps which are not required during the collating operation. U.S. Pat. No. 3,970,297 shows and describes apparatus for withdrawing a single top sheet from each bin as the bin reaches the ejecting position in the collator cycle. The sheet withdrawing invention described in the above patent can be used in conjunction with the present invention, as hereinafter disclosed.

U.S. Pat. No. 3,796,422 teaches the use of a sheet clamp release activating device which uses a toggle structure. The activating device of that invention is actuated each time a bin approaches its ejecting position, regardless of whether the bin contains sheets. The resulting objectionable noise and wear of parts are significant in that system.

Controlling discs have long been used in various fields to complete one or more electrical circuits at specified times for predetermined intervals of time, as shown and described, for example, in U.S. Pat. Nos. 2,623,132 and 2,866,021. The operation of these discs, however, has been dependent on time, per se, but independent of any other system functions. As such, these inventions are not suitable for application in the variable-speed collator art, since time alone is not necessary and sufficient to control an electrical circuit associated with a manual or automatic collator.

U.S. Pat. No. 4,003,566 teaches the use of a controlling disc, similar to that used in the present invention. Collating systems in the class represented by the above patent generally activate each sheet clamp once every collating cycle. Electrical switches are repeatedly made and broken in those systems. Associated sheet clamps are consequently also repeatedly clamped and released. With prior programming means the switch bounces. This bouncing severely limits the life of the switch and solenoid by causing excessive chatter and wear.

Accordingly, the present invention now reduces the noise associated with sheet clamping operations of a rotary collator by eliminating the switch bouncing between successively selected pins in the programming means. Only those sheet clamps which must be released, or opened, during the eject cycle of their corresponding bins are specified in advance. Certain bins which are either empty or loaded with unwanted sheets now remain intact in a closed position at all times during the collating cycle. The life expectancy of mechanical elements is extended by reducing wear on those clamp mechanisms associated with empty or unused bins. The total amount of energy expended for a normal collating project is also reduced by the present invention by activating less than all mechanisms during each sheet ejecting cycle.

SUMMARY OF THE INVENTION

Briefly, the present invention is comprised of a programming disc with insertable selector pins and an electromechanical rotatable follower. As the programming disc rotates beneath the follower in synchronization with a collator drum, an electrical circuit is completed and broken at specified times. When the circuit is broken, a solenoid is de-energized, forcing a cam in the activating means into the path of a toggle structure. The toggle structure causes a sheet clamp to release the stack so that a sheet may be withdrawn when a loaded bin reaches its ejecting position. The sheet clamp is then permitted to close again for the remainder of the collator cycle (i.e., until it again reaches the ejecting portion of its cycle).

From the foregoing discussion it is clear that an object of the present invention is to provide an improvement of a rotary collator.

Another object of the present invention is to provide a controller to release only specified sheet clamps during the collating cycle.

A further object of the present invention is to reduce the general operating noise associated with a rotary collator.

Yet another object of the present invention is to reduce energy consumption of a rotary collator when operating with less than all bins containing sheets.

Still another object of the present invention is to extend the life expectancy of sheet clamps by not actuating them when not in use.

BRIEF DESCRIPTION OF THE DRAWINGS

The novel features which are characteristic of the present invention are set forth with particularity in the claims, but the invention will be understood more clearly and fully from the following detailed description of a preferred embodiment thereof, as set forth in connection with the accompanying drawings in which:

FIG. 4 is a top view of a controller, including controlling disc and pins, for opening sheet clamps.

FIG. 5 is a side view of a controller as viewed from 5—5 of FIG. 4.

FIG. 6 is a simplified electrical circuit for energizing a solenoid.

FIG. 7 is a partial view of a collator drum and sheet clamps in relation to a sheet clamp closing means.

DESCRIPTION OF THE PREFERRED EMBODIMENT

Figure 1A:
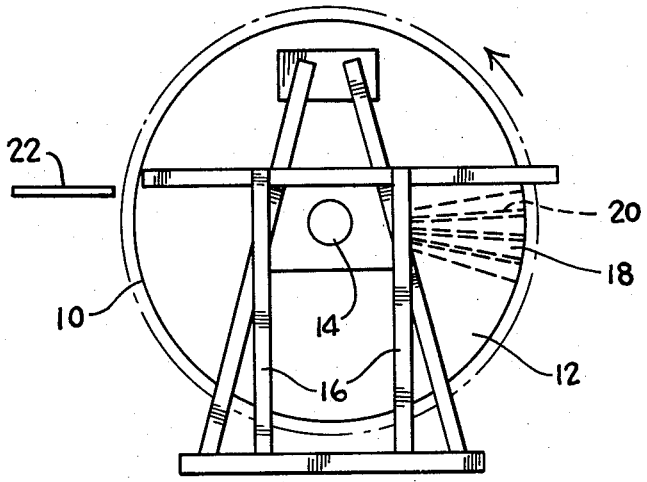
FIG. 1*a* is a diagrammatic view of a rotary collator.
Figure 1B:
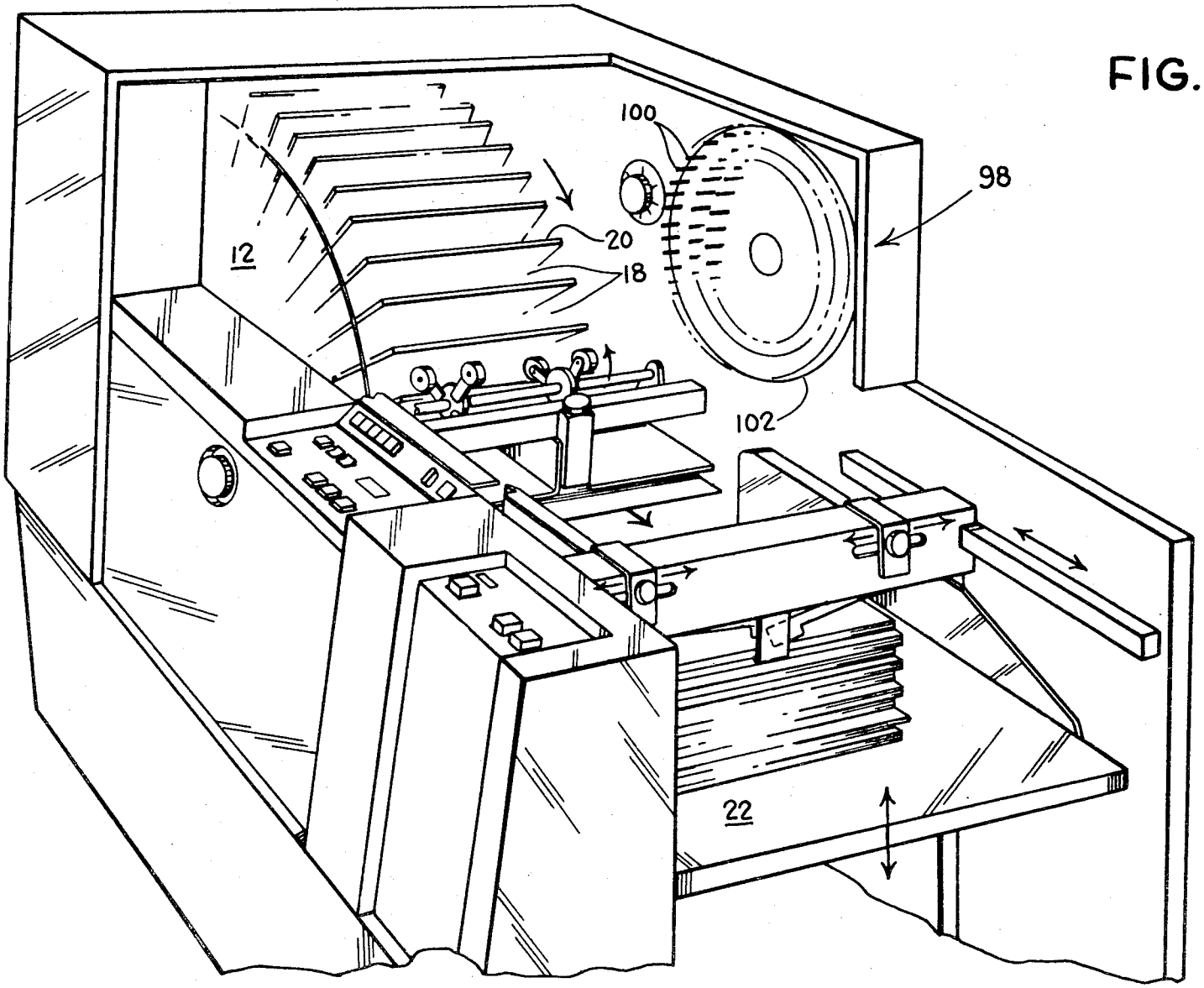
FIG. 1*b* is a perspective schematic view of a rotary collator.

Referring now to the drawings wherein a preferred embodiment of the invention is illustrated, FIGS. 1*a* and 1*b* disclose a rotary collator apparatus. The rotary collator includes a drum 10 having spaced side plates 12 which drum is mounted for rotation on an axle or shaft 14 carried by a suitable frame 16. The drum 10 is divided into a plurality of bins 18 by a plurality of spaced radially or substantially radially extending partitions 20 which are suitably secured to the spaced side plates 12. Each partition 20 forms a bin 18 for a stack of sheets, not shown. Suitable ejecting means, not shown, ejects the top sheet from the stack of sheets and delivers it to a receiving or transfer table 22 which establishes the ejecting position for each bin. In the rotary collator, each stack of sheets is disposed in generally horizontal position, resting on its partition 20 as it passes through the sheet ejecting position. As the drum 10 turns, the partitions 20 become disposed vertically with respect to the ground at the top and at the bottom of the drum 10. Clamping means, described in more detail hereinafter, are provided to retain each stack of sheets against its associated partition 20 through all or the major portion of the rotation of the drum 10 except for the sheet ejecting position and preferably shortly thereafter as will be further described hereinafter.

Figure 2:
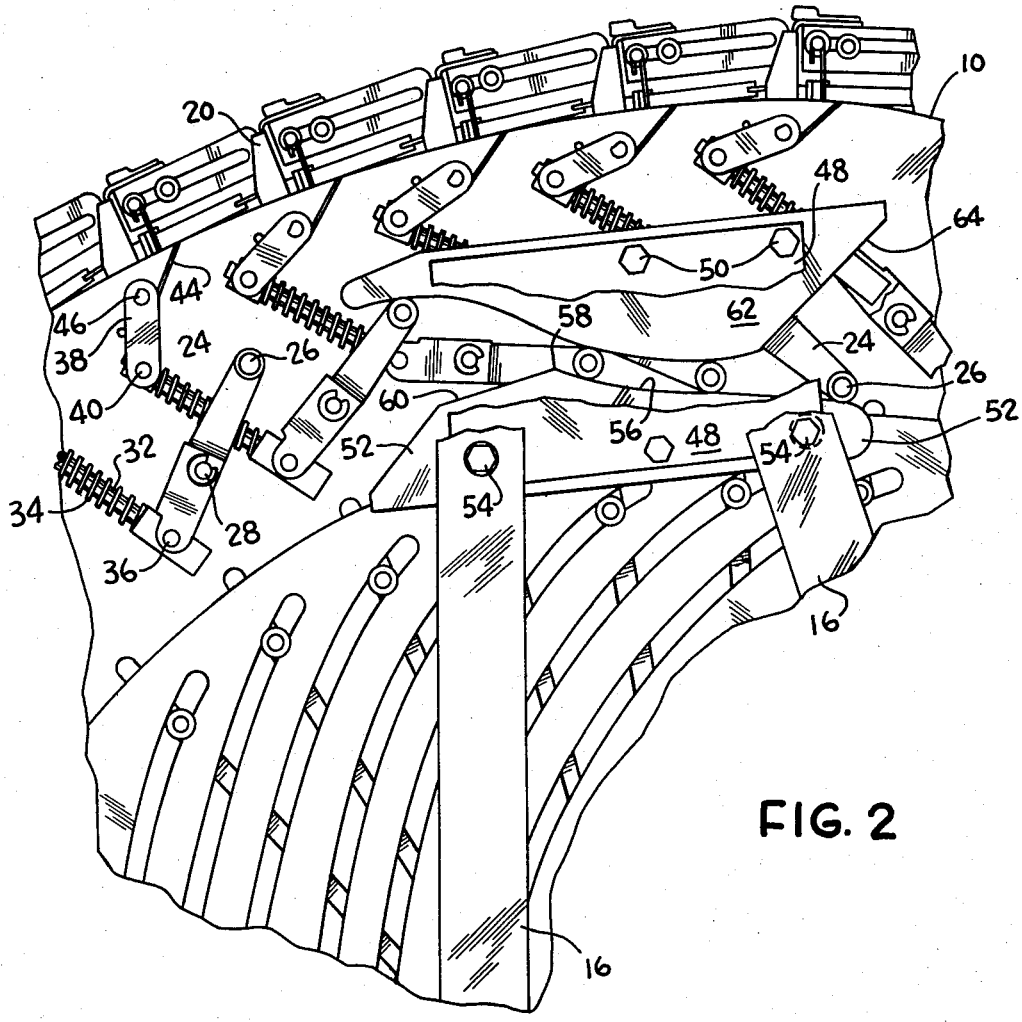
FIG. 2 is a partial view of a collator drum and sheet clamps in relation to a sheet clamp opening path.
Figure 3:
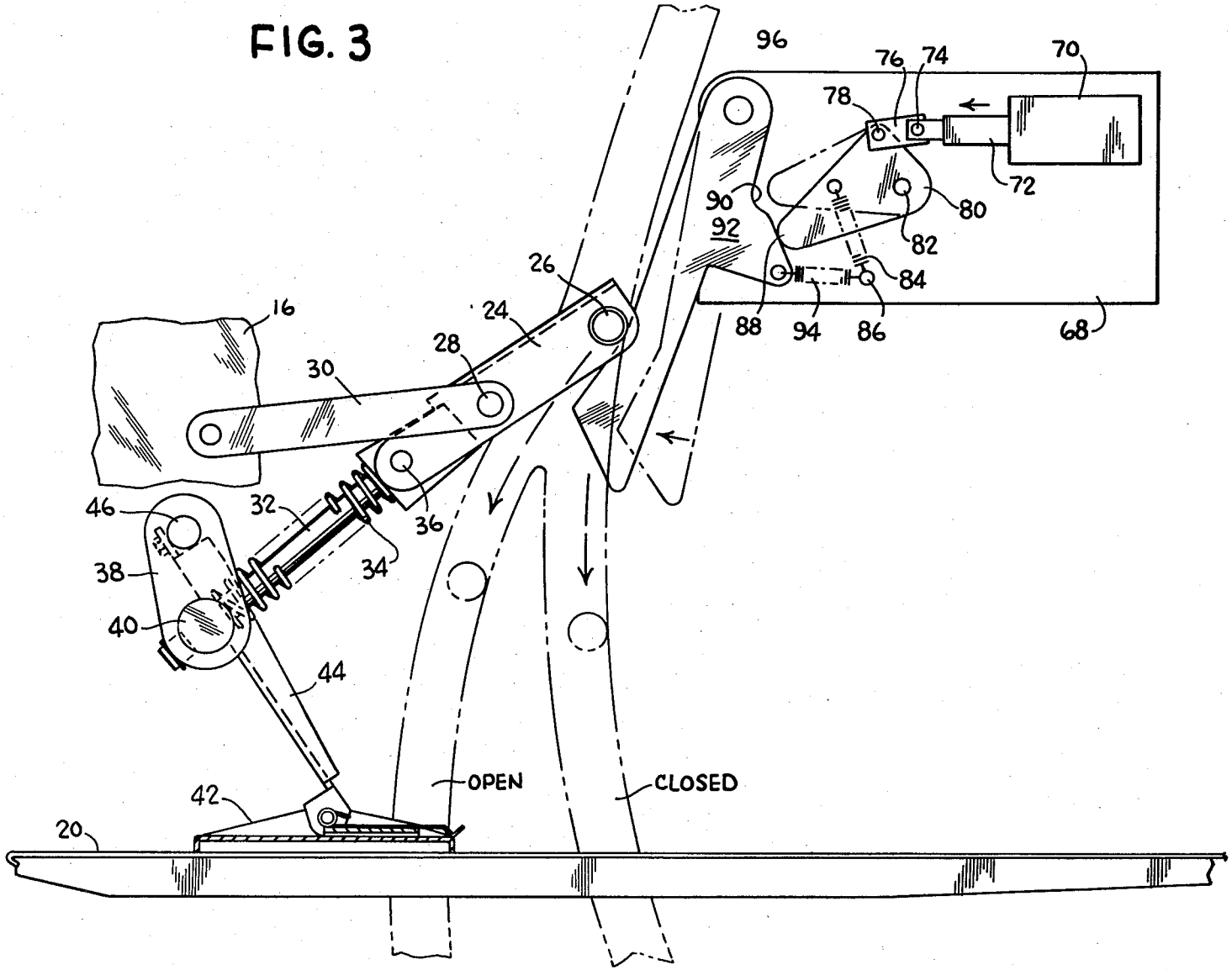
FIG. 3 is a detailed view of a sheet clamp and sheet clamp actuator.

Referring now to FIGS. 2 and 3, reference numeral 24 denotes a toggle extension. A cam follower 26 is suitably mounted on the toggle extension 24. The toggle extension 24 is rotatably mounted at a support pivot 28 to the revolving drum 10 by a supporting member 30. A shaft 32 inserted in a compression spring 34 connects the toggle extension 24 at a connection pivot 36 to a pivotable link 38 at a lower connecting pivot 40. The compression spring 34 is a spring with flat ends abutting their respective surface. The pivotable link 38 is connected to a clamp 42 by a clamp plate 44, which is connected to the pivotable link at an upper fixed pivot 46. The upper fixed pivot 46 is attached to the revolving drum 10. The clamp 42 normally rests on a partition 20 or on a stack of sheets loaded on said partition. The partition 20 is itself mounted on and part of the revolving drum 10.

The compression spring 34 has a length such that its pressure on the toggle extension 24 ceases or is light when the toggle is fully open. When the clamp 42 is closed on a stack of sheets or against the partition 20, the toggle extension 24 is in locked position with the connection pivot 36 past (above) a line between the centers of the pivots 28 and 40.

When a thick stack of sheets is on a partition 20, the compression spring 34 is at its maximum compression. Since usually the stack is half or less of capacity, this means that most of the time this compression spring 34 is operating in its area of lesser or minimum compression. The compression spring 34 is strong enough to hold the stack of sheets against its partition 20 without slippage in all positions of the latter. The compression spring 34 also accommodates for the varying thickness of the stack of sheets.

Cam means for maintaining an open clamp position, when required, is located adjacent to the top of the drum 10 and is carried by frame members 16. A cam mounting plate 48, forming a part of the frame 16, is secured to the frame by bolts 50. An opening cam 52 is attached to the cam mounting plate 48 by bolts 54. This opening cam 52 has a rising surface 56 part of which may be arcuate and which is engaged by selected cam followers 26 as the drum 10 rotates and opens the toggle extension 24. This rising surface 56 comes to a peak 58 after which the surface of the opening cam 52 drops away in angular portion 60. The contoured angle portion 60 of the opening cam 52 is provided to guide the cam follower 26 past the cam if the drum 10 is reverse rotated.

A restraining cam 62 is provided adjacent to the opening cam 52. A sharply angled clamp closing portion 64 is provided as a first part of the surface of the restraining cam 62 so that if a clamp 42 is open for any reason, the cam follower 26 engages this portion and closes the clamp. The restraining cam 62 then has a restraining portion 66 parallel to and spaced from the opening cam 52 by the diameter of the cam follower 26 to the peak 58 after which the surface of the restraining cam continues gradually outwardly to restrain any rapid opening of the clamp 42. Finally the restraining cam 62 levels out as the clamp 42 approaches full open position with the compression of the compression spring 34 largely or perhaps entirely dissipated. The clamp 42 is in full open position at least as the partition 20 nears sheet ejecting position.

Referring now again to FIG. 3, reference numeral 68 denotes generally an activating mechanism for switching the toggle extension 24 from one position (hereinafter the open position) to another position (hereinafter the closed position) constructed in accordance with the invention. A solenoid 70 is mounted on the non-revolving collator frame 16 shown in FIG. 1. The plunger 72 of the solenoid 70 is pivotably connected by means of a pin 74 to an extension bar 76 which is pivotably connected by means of a pin 78 to an interposer link 80. The interposer link 80 is pivotably mounted on the fixed collator frame 16 by means of a pin 82 located below the pivot pin 78.

One end of a tension spring 84 is connected to the interposer link 80 and the other end is attached to a point 86 on the fixed collator frame 16. The interposer link 80 has a protuberance 88 which fits and locks into a detent 90 of a switching cam 92. From the point 86 at which the first tension spring 84 is connected to the interposer link 80, another tension spring 94 is connected to the switching cam 92. The switching cam 92 is pivotably mounted by pin 96 to the fixed collator frame 16.

Referring now to FIGS. 4 and 5, a typical controlling mechanism is shown generally at 98 and is constructed in accordance with the invention. A plurality of selector pins 100 are inserted along the circumference of a rotating programming disc 102. An electro-mechanical controlling mechanism 104 is mounted on the fixed collator frame 16 and aligned on the controlling disc 102. The electro-mechanical controlling mechanism 104 consists of a rotatable follower 106 mounted on a control toggle 108 which is fixed at a pivot point 110. The rotatable follower 106 can be in the shape of a disc or a ball 107. One side of this control toggle 108 contains a point 112 through which an axle 114 is inserted, supporting the rotatable follower 106. A rigid protuberance 116 is mounted on the other side of the control toggle 108. The rigid protuberance 116 is located directly below an electrical switch 118 which is also mounted on the electro-mechanical controlling mechanism 104.

In operation, a sheet clamp 42 allows a sheet to be extracted during a certain portion of a collating cycle only. The clamp 42 restrains or releases sheets stacked on the partition 20 on which it rests, according to a disabling program. The electro-mechanical controlling mechanism 104 releases sheet clamps 42 associated with pre-selected partitions 20 automatically at a specified time in the sheet ejecting cycle.

When one or more selector pins 100 are pulled out from the programming disc 102, the rotatable follower 106 mounted on the electro-mechanical controlling mechanism 104 is unimpeded as the disc 102 moves beneath it. The rotatable follower 106 is in a low position relative to the electro-mechanical controlling mechanism 104, so the rigid protuberance 116 on the opposite side of the pivot point 112 is in a high position, pressing against, and enabling, the electrical switch 118.

Referring now to FIG. 6, a schematic electrical circuit is shown generally at 120 and is constructed in accordance with the invention. The solenoid 70 is in electrical series with the electrical switch 118 and a power source 122. Enabling the electrical switch 118 completes the electrical circuit 120 and energizes the solenoid 70.

Referring now to FIG. 7, reference numeral 124 denotes a closing cam. This closing cam 124 has a contoured rising surface 126 which is engaged by selected cam followers 26 as the drum 10 rotates and closes the toggle extension 24. This rising surface 126 comes to a peak 128 after which the cam surface drops away in angular portion 130. The angular portion 130 of the closing cam 124 is provided to guide the cam follower 26 past the cam if the drum 10 is reverse rotated.

In operation, the electrical switch 118 is enabled during the sheet ejecting portion of the collating cycle and completes the electrical circuit 120, energizing the solenoid 70. When the solenoid 70 is energized, its plunger 72 holds the extension bar 76 back. The interposer link 80 remains in a clockwise orientation on its pin 82, overcoming the tension spring 84 attached to it. The protuberance 88 of the interposer link 80 is seated in the detent 92 of the switching cam 90. In this position, the switching cam 90 is restrained by the tension spring 94 attached to it, and is not brought into contact with the cam follower 26 mounted on the toggle extension 24 as the follower moves in its trajectory past the cam. The cam follower 26 moves along the lower path of the opening cam 52. Consequently, none of the members connected to the toggle extension 24—including the shaft 32 and compression spring 34, the pivotable link 38, the clamp plate 44, and the clamp 42—is moved from its normal position. The clamp 42 is pressed against its partition 20 during all portions of the collating cycle including the sheet ejection portion, when power is applied to the solenoid 70.

Means are provided for synchronizing the controlling mechanism 98 both with the activating mechanism 68 and with the revolving collator drum 10, such that at a specified time in the sheet ejecting cycle, power is applied to the activating mechanism 68, causing the clamp 42 to remain closed. Details of this synchronizing means are not required to understand the operation of the controlling 98 or of the activating 68 mechanisms.

When pins 100 are inserted in the programming disc 102, the rotatable follower 106 is forced up, to clear the obstructions as the disc moves beneath it. The diameter "d" of the rotatable follower 106 is considerably larger than the distance "D" between two adjacent pins 100, so if two or more adjacent pins are inserted in the disc 102, the rotatable follower remains in a high operating position from one pin to the next without causing bouncing of the switch 118. That is, the size of the rotatable follower 106 relative to the distance "D" between pins 100 does not allow the rotatable follower to dip between adjacent inserted pins. Thus, the follower 106 cannot move to a low operating position unless at least one pin 100 is not inserted in the disc 102.

Because the rotatable follower 106 is in a high position, the rigid protuberance 116 on the opposite side of the pivot point 112 is in a low position, removed from and disabling, the electrical switch 118.

If no sheets are to be removed for a specific bin 18 during the sheet ejecting portion of the collating cycle, the electrical switch 118 is disabled, breaking the electrical circuit 120, de-energizing the solenoid 70. When power is removed from the solenoid 70, its plunger 72 is extended, driving the extension bar 74 forward. The interpower link 80 is forced to move in a counter-clockwise direction on its pin 82, aided by the tensile force of the tension spring 84 attached to it. The protuberance 88 of the interposer link 80 moves down and out of the detent 92 in the switching cam 90. In this position, when the interposer link 80 presses into the power portion of the switching cam 90, the cam is forced to move around its pivot 96 in a clockwise direction. The lower portion of the switching cam 90 moves into the trajectory of the cam follower 26, forcing the toggle extension 24 up. The upper portion of the toggle extension 24 is driven in a counter-clockwise direction around its support pivot 28. The cam follower 26 is guided along the upper path 56 of the opening cam 52, which forces the toggle extension 24 even further into a counter-clockwise position. When the can follower 26 reaches the peak 58 of the opening cam 52, the toggle extension 24 has been broken from locked position so that the compression spring 34 takes over to continue the opening of the toggle extension 24 until the spring has reached an expansion of reduced compression to open the clamp 42.

The lower portion of the toggle extension 24 moves counter-clockwise about its support pivot 28, increasing the distance between pivots 28 and 40. A tensile force is generated along the compression spring 34, tending to pull the pivotable link 38 in a counter-clockwise direction about its upper fixed pivot 46. The upper fixed pivot 46 is fixed to the clamp plate 44, so a counter-clockwise movement of the pivotable link 38 causes the clamp plate 44 and the clamp 42 attached to it to swing up off the partition 20 also in a counter-clockwise direction, generally towards the center of the collator drum 10. In this released position, a sheet can be withdrawn from a stack of sheets, if present, which rests on the partition 20.

After the partition 20 has passed sheet ejecting position and a sheet has been ejected and withdrawn from the bin 18, the closing cam 124 is engaged by the cam follower 26 to close the clamp 42. Preferably the clamp 42 is closed a short distance after passing ejecting position so that if the second sheet has been partially projected outwardly it can be pushed back before the clamp is fully closed.

The closing cam 124 is located approximately on a horizontal line through the center of the drum 10. The closing cam 124 begins with a surface 126 generally rising inwardly until the clamp 42 is practically closed. At this point a spring pressed cam 132 moves the toggle extension 24 to locked position. The spring pressed cam 132 is pivoted on a pin 134 and has a curved surface 136 extending inwardly to engage the cam followers 26 and complete the closing of the toggle extension 24 to locked position. The spring pressed cam 132 is propelled radially inwardly by a spring 138, one end of which is fixed to a pin 140 on the closing cam 124. The spring pressed cam 132 provides assurance that the toggle extension 24 is closed. The clamp 42 remains in this closed position until the collating drum 10 is again rotated to a position where the cam follower 26 is brought into contact with the swtiching cam 92.

Should the clamp 42 be jammed for any reason, the compression spring 34 yields and if the toggle extension 24 should jam, the spring pressed cam 132 yields and in this manner protects the clamp 42 and the asociated mechanism from being damaged. The angular portion 130 of the closing cam 124 continues radially outwardly so that it engages the cam follower 26 in the event that the drum 10 is reverse rotated.

Preferably the clamp 42 is opened about six bins 18 before sheet ejecting position so the bins can be loaded with sheets in this quadrant of drum 10 rotation when the clamps 42 are open. A sheet backstop, not shown, provided in the bins 18 retains the sheets undisturbed in their bin and on their partition 20.

The synchronizing means, not shown, coordinates the controlling mechanism 98 with the activating mechanism 68 such that once the cam follower 26 of the toggle extension 24 passes the lower-most part of the switching cam 92. the rotatable follower 106 of the electro-mechanical controlling mechanism 104 also passes the associated pin 100. The rotatable follower 106 may then be lowered, causing the electrical switch 118 to be enabled, and completing the electrical circuit 120. Consequently, the solenoid 70 is energized and all elements of the activating mechanism 68 return to their initial closed positions. The rotatable follower 106 may have the shape of a disc or a ball.

This invention is presented to fill a need for improvement in a rotary collator. It is understood that various modifications in structure, as well as changes in mode of operation, assembly and manner of use, may and often do occur to those skilled in the art, especially after benefitting from the teachings of an invention. This disclosure illustrates the preferred means of embodying the invention in useful form.

What is claimed is:

1. In a rotary collator having a high speed rotating drum with a plurality of bins therein from which sheets are ejected and a synchronously rotating programming disc for controlling the actuation of an electrical actuating means for a clamping means in each of said bins, which normally opens and closes during an ejection cycle, apparatus for preventing inadvertent actuation of said electrical actuating means operated by said rotating programming disc, said apparatus comprising:

A. a plurality of selector pins mounted on said disc so as to be movable between two oppositely disposed spaced apart positions relative to said disc, said spaced apart positions corresponding to a closed or open position of said clamping means, said pins being equi-spaced with respect to one another;

B. a circular follower adapted to be moved by contact with said pins between two operating positions depending upon the positions of said pins with respect to said spaced apart positions thereof;

C. means for pivotably mounting said follower in position to be contacted by said pins as said disc is caused to rotate; and D. means responsive to a pivoted movement of said follower for operating said electrical actuating means for causing said clamping means to remain closed during the ejection cycle when the clamping means would normally be opened, said follower having a diameter sufficiently greater than the spacing between two adjacent pins so that said follower can move from one of said operating positions to the other only when said follower is contacted successively by two adjacent pins which are in said oppositely disposed spaced apart positions, whereby, as said disc rotates at a high rate of speed to cause said pins to move past said follower, said electrical actuating means cannot be inadvertently actuated to allow the clamping means to open during the ejection cycle when it should remain closed.

2. The apparatus of claim 1, wherein said rotatable follower is disc-shaped.

3. The apparatus of claim 1, wherein said rotatable follower is spherical-shaped.

* * * * *